US008752345B1

(12) United States Patent
Kometas

(10) Patent No.: US 8,752,345 B1
(45) Date of Patent: Jun. 17, 2014

(54) APPARATUS AND METHOD FOR FRAMING WINDOWS AND DOORS

(76) Inventor: Athas N. Kometas, Port Orange, FL (US)

( * ) Notice: Subject to any disclaimer, the term of this patent is extended or adjusted under 35 U.S.C. 154(b) by 1055 days.

(21) Appl. No.: 12/589,973

(22) Filed: Oct. 30, 2009

Related U.S. Application Data

(63) Continuation-in-part of application No. 10/862,155, filed on Jun. 7, 2004, now abandoned.

(51) Int. Cl.
*E06B 1/04* (2006.01)
*E04B 5/04* (2006.01)
*E04C 2/38* (2006.01)

(52) U.S. Cl.
USPC ..... 52/215; 52/608; 52/656.5

(58) Field of Classification Search
CPC ..... E04B 2/02; E04B 2/04; E04B 2002/02; E06B 1/24; E06B 1/58
USPC ..... 52/210, 204.2, 215, 213, 506.01, 598, 52/656.2, 656.4, 656.5, 608
See application file for complete search history.

(56) References Cited

U.S. PATENT DOCUMENTS

| | | | | | |
|---|---|---|---|---|---|
| 699,537 | A | * | 5/1902 | Lahmann | 52/286 |
| 1,299,180 | A | * | 4/1919 | Hardoncourt | 52/284 |
| 1,396,543 | A | * | 11/1921 | Walker | 52/213 |
| 1,459,189 | A | * | 6/1923 | Swanson | 52/586.1 |
| 1,805,538 | A | * | 5/1931 | Anderberg | 52/215 |
| 2,166,870 | A | * | 7/1939 | Livesay | 52/213 |
| 2,705,415 | A | * | 4/1955 | Livesay | 52/204.5 |
| 3,025,641 | A | * | 3/1962 | Ahtiainen | 52/415 |
| 3,076,293 | A | * | 2/1963 | Baudoux | 52/204.1 |
| 3,230,676 | A | * | 1/1966 | Dixon | 52/223.1 |
| 3,305,982 | A | * | 2/1967 | Steele | 52/90.1 |
| 3,605,372 | A | * | 9/1971 | Wunderlich | 52/747.12 |
| 4,020,612 | A | * | 5/1977 | Welch | 52/204.2 |
| 4,123,889 | A | * | 11/1978 | Deloupy | 52/742.12 |
| 4,442,644 | A | | 4/1984 | Jukes | |
| 4,573,301 | A | * | 3/1986 | Wilkinson | 52/607 |
| 5,138,808 | A | * | 8/1992 | Bengtson et al. | 52/204.2 |
| 5,169,544 | A | | 12/1992 | Stanfill et al. | |
| 5,603,191 | A | | 2/1997 | Wu | |
| 5,711,129 | A | * | 1/1998 | Woolford | 52/604 |
| 5,934,039 | A | * | 8/1999 | Guy | 52/747.12 |
| 5,996,293 | A | | 12/1999 | Anderson et al. | |
| 6,088,987 | A | * | 7/2000 | Simmons et al. | 52/592.6 |

(Continued)

OTHER PUBLICATIONS

Corrected PTO-892 from Dec. 19, 2011 (name entered for Document G).*

*Primary Examiner* — Ryan Kwiecinski
(74) *Attorney, Agent, or Firm* — Allen, Dyer et al.

(57) ABSTRACT

An apparatus and method for framing windows and doors. The apparatus includes buck blocks each having a block buck strip on one side, first furring strip, first finishing sheet, second finishing sheet, and optional second furring strip and buck lentil having a lentil buck strip extending along its bottom. The method includes the steps of laying buck blocks up opposing sides of an opening with their block buck strips facing into the opening, installing a window or door frame in the opening, installing a first furring strip, installing the first and second finishing sheets, and trimming the second finishing sheet flush with the first finishing sheet. The second finishing sheet proximal edge is wedged securely between the buck strip ramp and the frame outer side by virtue of a preferred embodiment buck strip ramp angle of 34 degrees±15 degrees.

21 Claims, 10 Drawing Sheets

(56) References Cited

U.S. PATENT DOCUMENTS

| | | | | |
|---|---|---|---|---|
| D464,145 | S * | 10/2002 | Scherer et al. | D25/113 |
| 6,550,194 | B2 | 4/2003 | Jackson et al. | |
| 6,865,850 | B1 * | 3/2005 | Campbell | 52/202 |
| 7,490,442 | B1 * | 2/2009 | Jackson et al. | 52/215 |
| D633,629 | S * | 3/2011 | MacDonald et al. | D25/113 |
| 2004/0074167 | A1 | 4/2004 | Drost | |
| 2004/0148890 | A1 * | 8/2004 | Miniter | 52/483.1 |
| 2011/0214370 | A1 * | 9/2011 | Stewart | 52/215 |
| 2013/0219814 | A1 * | 8/2013 | Piccirillo | 52/215 |

* cited by examiner

APPARATUS AND METHOD FOR FRAMING WINDOWS AND DOORS

CLAIM FOR PRIORITY

This utility patent application is a continuation-in-part based upon and claims the benefit of the earlier filing date of U.S. utility patent application Ser. No. 10/862,155 filed Jun. 7, 2004 now abandoned entitled Apparatus and Method for Framing Windows and Doors.

BACKGROUND OF THE INVENTION

1. Field of the Invention

This invention relates to building construction, and in particular to an apparatus and method for framing windows and doors.

2. Background of the Invention

One of the more common challenges involved in building construction is the framing of window and door openings. Conventional methods include use of buck strips around the raw opening, onto which window and/or door frames are attached.

This method requires one set of expensive tapcons (self-tapping concrete fasteners) to attach the buck strips, and another set of tapcons to attach the window or door frame to the buck strips. In addition, this method requires three building inspections under most current building codes: first the block inspection, then the buck strip inspection, finally the window and door inspection.

Still another problem associated with current window and door framing practice is the inaccuracies inherent therein. The blocks are typically laid up to the sill, then the blocks comprising both sides of the opening are laid, finally a precast lentil is laid across the top of the opening.

The resultant opening is rarely completely square and of the correct dimensions, so it is not unusual to have to use shims and other expediencies to make the window or door frame fit into the opening as built.

SUMMARY OF THE INVENTION

Accordingly, it is an object of the present invention to provide an apparatus and method for framing windows and doors which results in a square, correctly dimensioned opening. Design features allowing this object to be accomplished include buck blocks, a frame, and a buck lentil. Advantages associated with the accomplishment of this object include reduced installation time and cost.

It is another object of the present invention to provide an apparatus and method for framing windows and doors which may eliminate one of the progressive building inspections. Design features allowing this object to be accomplished include buck blocks, a frame, and a buck lentil. Benefits associated with the accomplishment of this object include obviating the necessity of conducting a progressive building inspection and the associated work stoppage, faster building construction, and the associated cost savings.

It is still another object of this invention to provide an apparatus and method for framing windows and doors which eliminates the tapcons required to attach buck strips to the raw opening. Design features enabling the accomplishment of this object include buck blocks having integral block buck strips, and a buck lentil having an integral lentil buck strip. Advantages associated with the realization of this object include the cost savings of the concrete fasteners required to attach conventional buck strips to a window or door opening, and the labor saved by not having to attach conventional buck strips to the opening.

BRIEF DESCRIPTION OF THE DRAWINGS

The invention, together with the other objects, features, aspects and advantages thereof will be more clearly understood from the following in conjunction with the accompanying drawings.

Ten sheets of drawings are provided. Sheet one contains FIGS. 1 and 2. Sheet two contains FIGS. 3 and 4. Sheet three contains FIGS. 5 and 6. Sheet four contains FIGS. 7 and 8. Sheet five contains FIGS. 9 and 10. Sheet six contains FIGS. 11 and 12. Sheet seven contains FIG. 13. Sheet 8 contains FIGS. 14 and 15. Sheet nine contains FIGS. 16 and 17. Sheet ten contains FIGS. 18 and 19.

DETAILED DESCRIPTION OF THE PREFERRED EMBODIMENT

Figure 11:
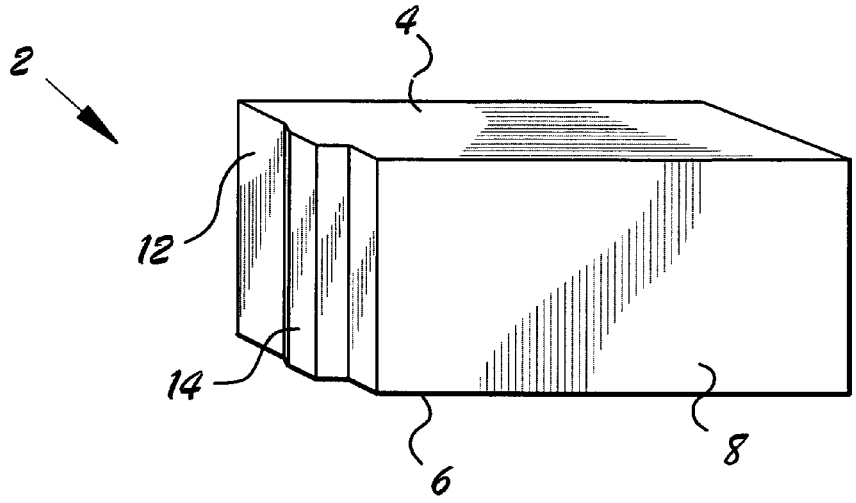
FIG. 11 is a front quarter isometric view of a buck block.
Figure 12:
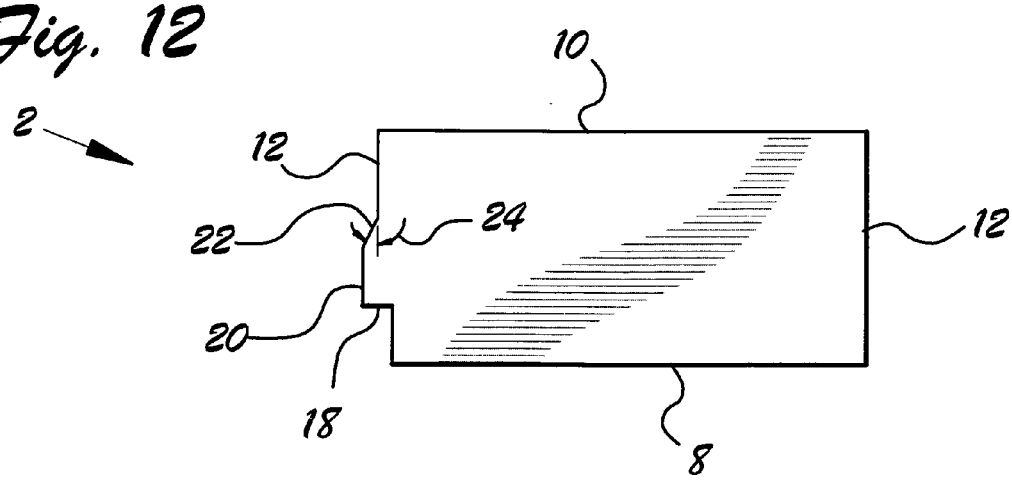
FIG. 12 is a top view of a buck block.

One basic component of the instant framing apparatus is buck block 2. FIGS. 11 and 12 depict the preferred embodiment of buck block 2. Buck block 2 comprises buck block top 4, buck block bottom 6, buck block front 8, buck block rear 10, and buck block sides 12. Block buck strip 14 is disposed on one buck block side 12, extending from buck block bottom 6 to buck block top 4.

As may be observed in FIG. 12, block buck strip 14 comprises buck strip face 18 perpendicular to buck block side 12 and disposed at an edge of block buck strip 14 nearest buck block front 8. Block buck strip 14 further comprises buck strip ramp 22 disposed at a buck strip ramp angle 24 to buck block side 12, and disposed at an edge of block buck strip 14 nearest buck block rear 10. In the preferred embodiment, buck strip ramp angle 24 was 34 degrees±15 degrees. Buck strip side 20 is disposed on block buck strip 14 between buck strip ramp 22 and buck strip face 18, and is substantially parallel to buck block side 12.

In the preferred embodiment, buck block 2 is monolithic, one-piece, that is, made of a single block of material. This unitary construction avoids the necessity of using expensive fasteners such as concrete tapcons to attach block buck strip 14 to buck block 2.

Figure 10:
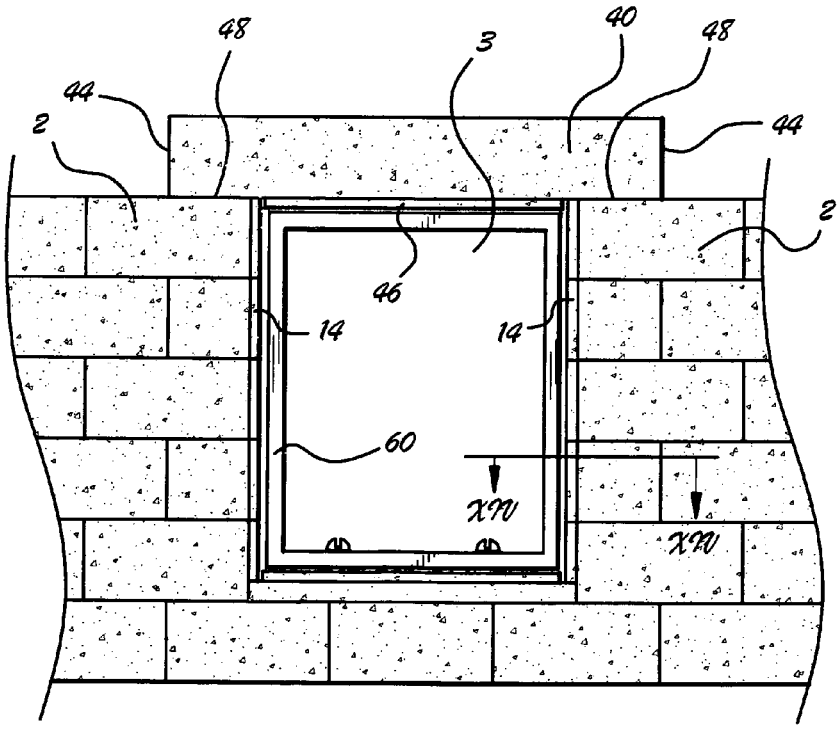

FIGS. 1-6 depict the instant apparatus and method of framing doors and windows including the steps of laying tiers of conventional blocks 1, a sill 30, then tiers of buck blocks 2 until the top of opening 3 has been reached, and then topping off opening 3 with a buck lentil 40. A frame for opening 3 may then be installed, such as a door frame or window frame 60 as depicted in FIG. 10. The instant drawings depict installation of window frame 60, but it is intended to fall within the scope of this disclosure that any appropriate frame be installed, including but not limited to a door frame, etc.

Figure 7:
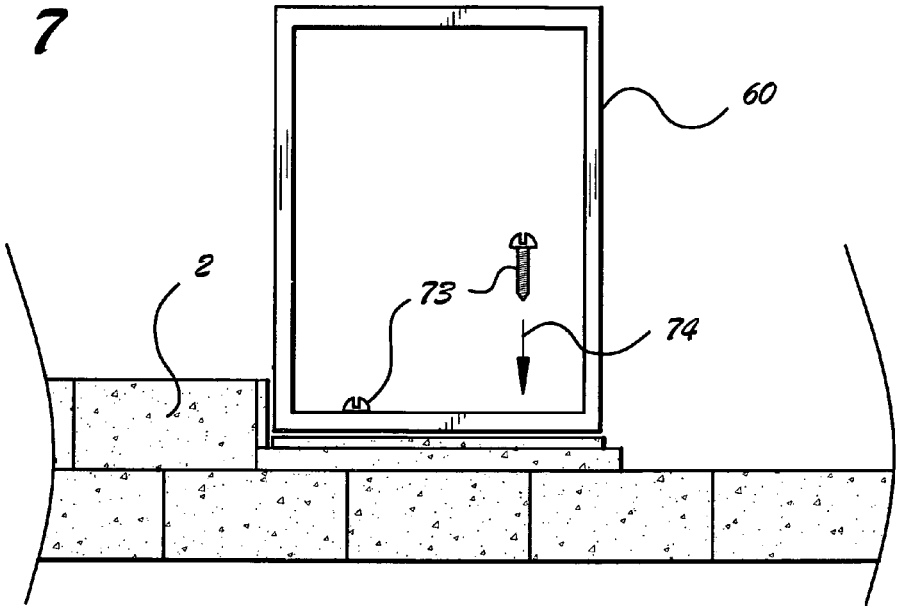
FIGS. 7-10 depict the steps of installing a frame in the opening after the sill and initial buck blocks have been installed, and then continuing to lay buck blocks butting up against the sides of the frame until the top of the frame is reached, after which the buck lentil is installed.
Figure 8:
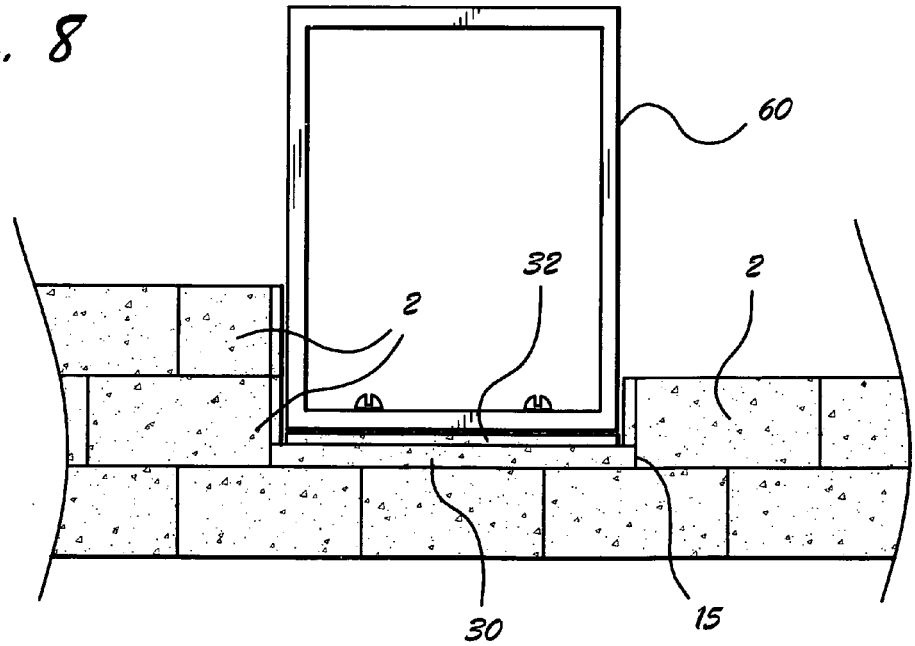
Figure 9:
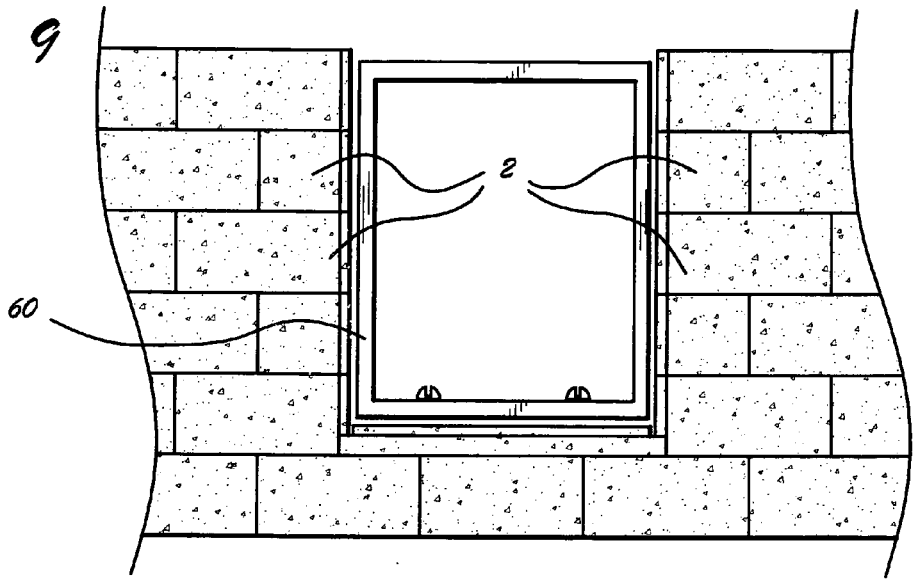

In the alternative, a frame for opening 3 such as a door frame or window frame 60 may be installed after sill 30 and initial buck blocks 2 have been installed. This procedure is illustrated in FIGS. 7-9. Regardless of whether window frame 60 is installed early or after opening 3 is complete the result is the same: a frame such as window frame 60 installed in opening 3, as depicted in FIG. 10. Steps 14-19 depict the subsequent steps of finishing off opening 3 by installing furring strips and finishing sheets around opening 3.

Figure 1:
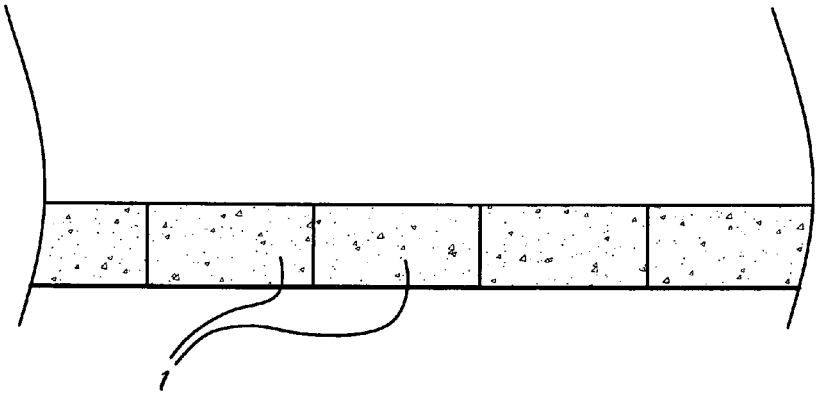
FIGS. 1-6 depict the instant apparatus and method of framing doors and windows including the steps of laying tiers of conventional blocks, a sill, then tiers of buck blocks until the top of the opening has been reached, and then topping off the opening with a buck lentil.
Figure 2:
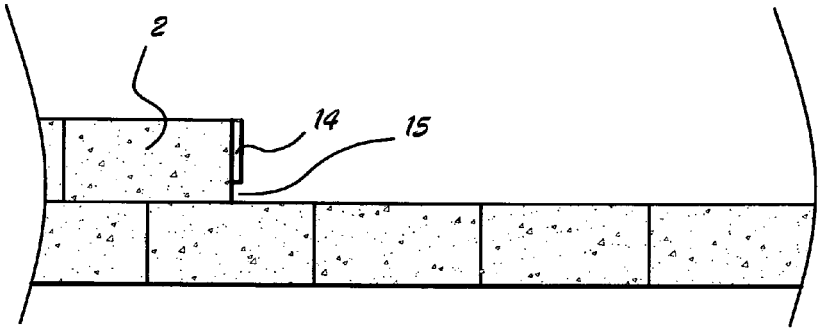

FIGS. 1-6 depict the instant apparatus and initial method steps of framing doors and windows. Blocks 1 are laid in tier(s) in conventional fashion as illustrated in FIG. 1. Where a window or door is to be installed, a buck block 2 is laid with its block buck strip 14 facing the opening, as is depicted in FIG. 2. Buck block 2 is depicted in greater detail in FIGS. 11 and 12.

Figure 3:
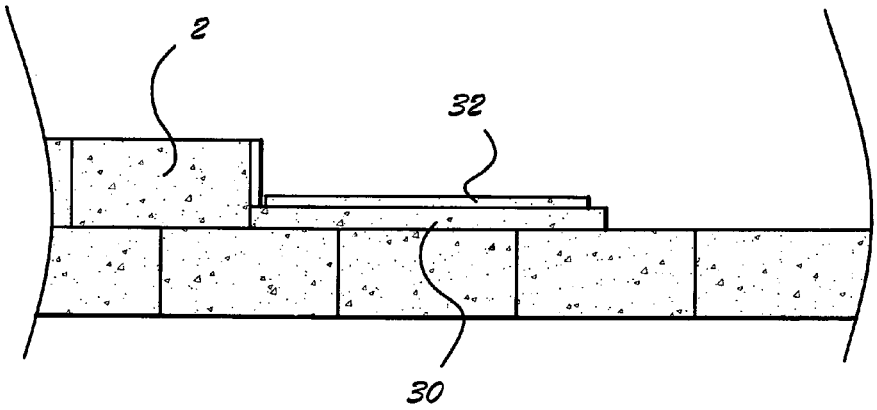

The buck block 2 depicted in FIG. 2 has buck block strip cutout 15 at the lower extreme of block buck strip 14. Buck block strip cutout 15 may be pre-cut into buck block 2, or may be effectuated in the field, e.g. by cutting with a cement saw, knocking out with a hammer, or any other appropriate method known in the art. Buck block strip cutout 15 is sized to admit one extreme of sill 30, as is depicted in FIG. 3. Buck block strip cutout 15 may also be sized to admit one extreme of sill buck strip 32, depending on the configuration sill 30 used.

Figure 4:
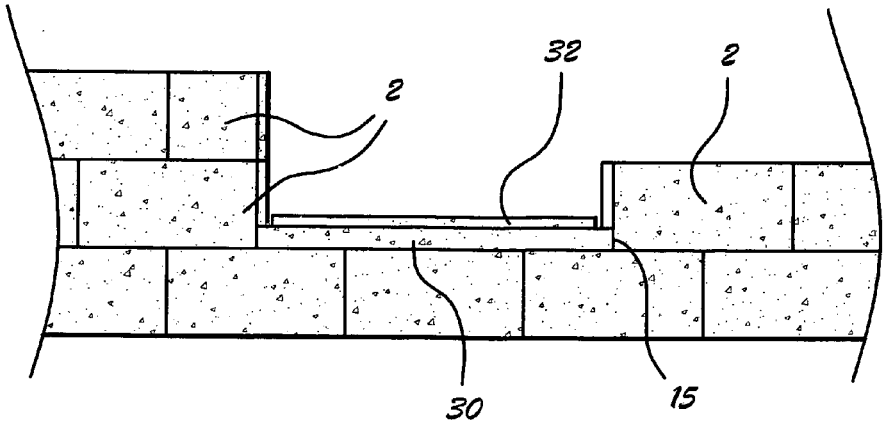
Figure 5:
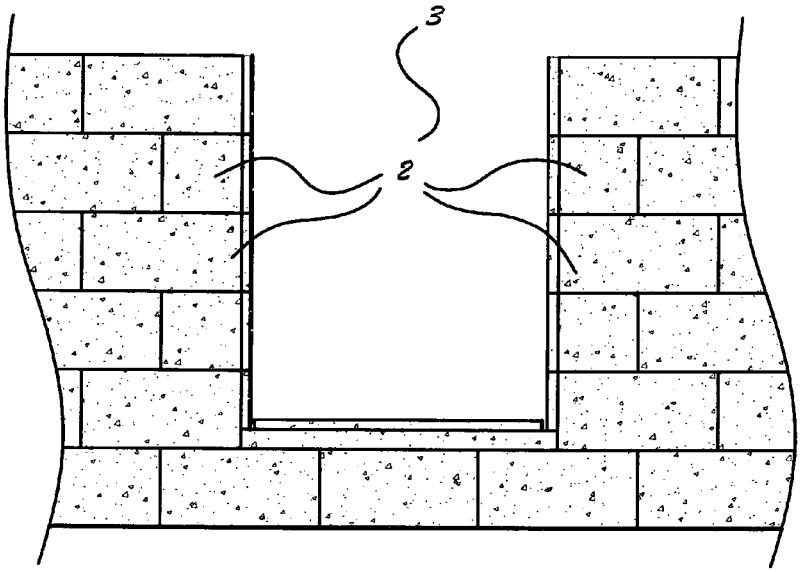
Figure 6:
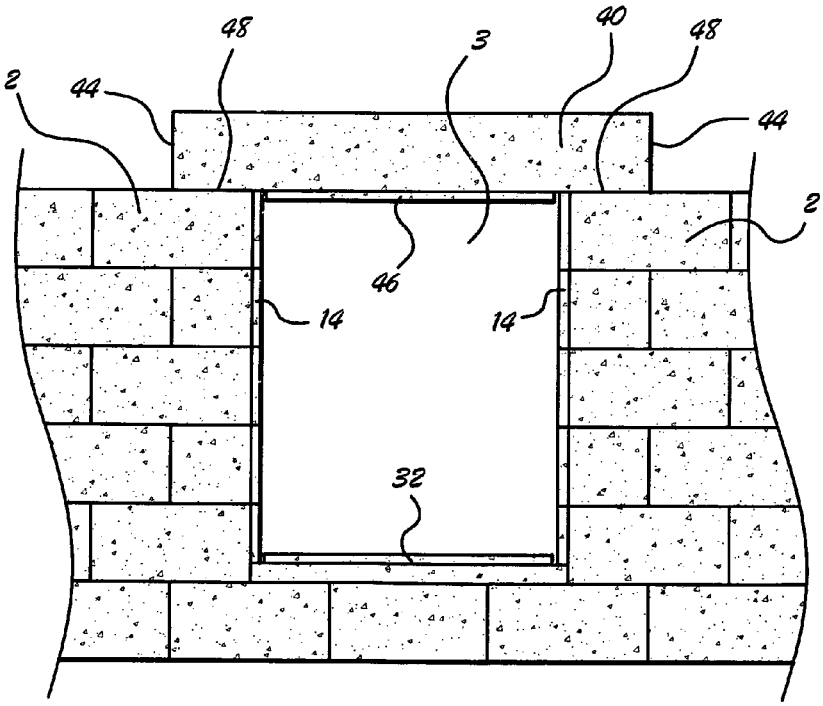

Sill 30 is laid in conventional manner adjacent buck block 2, and then an additional buck block 2 having an appropriate buck block strip cutout 15 is laid adjacent sill 30, as is depicted in FIG. 4. Additional tiers of buck blocks 2 are laid with their block buck strips 14 facing opening 3, as depicted in FIGS. 4 and 5. FIGS. 4 and 5 depict buck blocks 2 being laid in alternating full buck block 2 and half buck block 2 sizes, to avoid collinear mortar joints.

Figure 13:
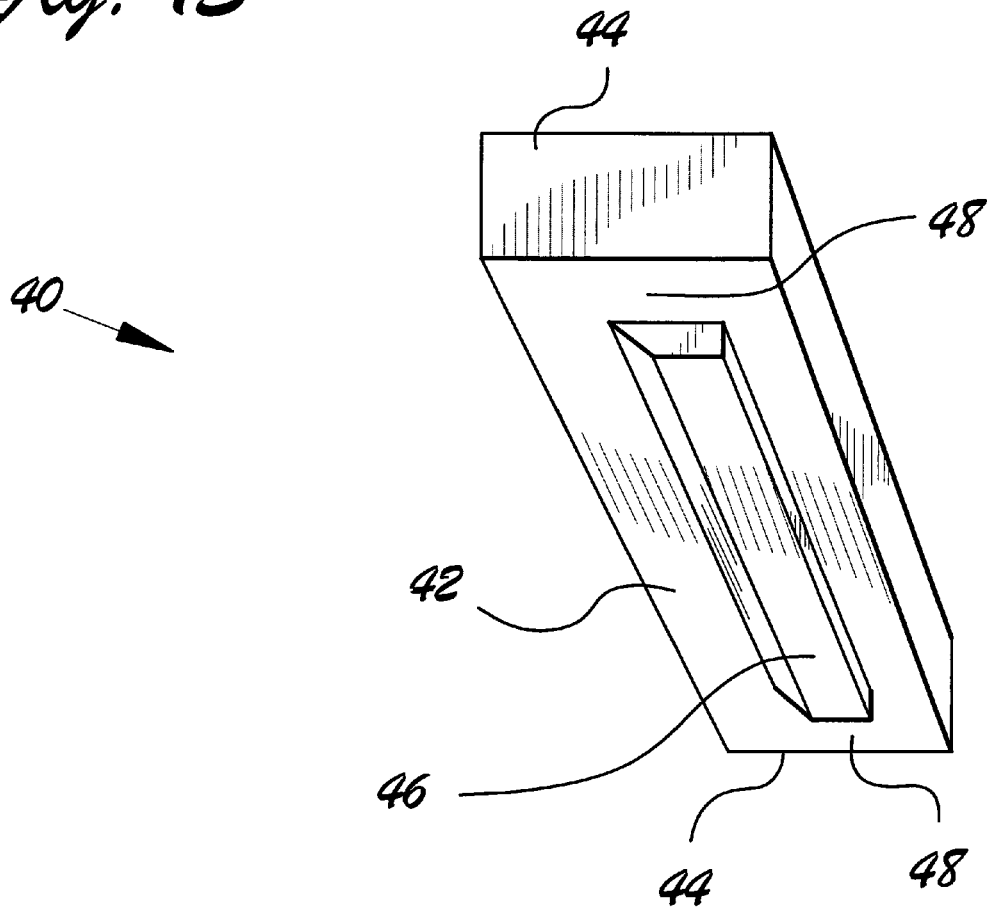
FIG. 13 is a bottom side isometric view of a buck lentil.

When sufficient tiers of buck blocks 2 have been laid for opening 3 to reach its desired height, buck lentil 40 is laid across the top of opening 3, with its lentil buck strip 46 facing opening 3 and buck lentil sides 44 overlying supporting buck blocks 2. As may be more clearly observed in FIG. 13, buck lentil 40 comprises lentil buck strip 46 disposed on buck lentil bottom 42. A lentil buck strip cutout 48 is disposed at either extreme of lentil buck strip 46 between buck lentil sides 44 and lentil buck strip 46. As may be observed in FIG. 6, lentil buck strip 46 is sized to fit between the opposing block buck strips 14 corresponding to the two uppermost buck blocks 2. In the preferred embodiment, a cross-sectional shape of lentil buck strip 46 was substantially the same as a cross-sectional shape of block buck strip 14.

After sill 30, buck blocks 2, and buck lentil 40 are installed, the wall is finished in conventional fashion. A door or window frame 60 may then be attached to sill buck strip 32, block buck strips 14, and lentil buck strip 46 with appropriate fasteners, such as concrete fasteners, as depicted in FIG. 10. The frame is now ready for finishing, as depicted in FIGS. 14-19.

FIGS. 7-9 depict an alternative method of constructing opening 3, wherein a frame such as a door frame or window frame 60 is attached to sill 30 and buck blocks 2 using fasteners 73. The steps depicted in FIGS. 1-3 remain the same. Then window frame 60 is attached to sill 30 at sill buck strip 32 using one or more appropriate fasteners 73, such as concrete fasteners, as depicted by arrow 74 in FIG. 7, or using any other appropriate means.

Next buck blocks 2 are installed in tiers until reaching the top of window frame 60, their respective block buck strips 14 flush against window frame 60, as illustrated in FIG. 9.

After buck blocks 2 have been laid to the top of opening 3, buck lentil 40 is laid across the top of opening 3, its lentil buck strip 46 flush against the top of window frame 60, as shown in FIG. 10.

Regardless of whether window frame 60 is installed early as depicted in FIGS. 7-10, or after opening 3 is complete as illustrated in FIGS. 1-6 and 10, the result is the same: a frame such as window frame 60 installed in opening 3, as depicted in FIG. 10. Steps 14-19 depict the subsequent steps of finishing off opening 3 by installing furring strips and finishing sheets around opening 3.

Figure 14:
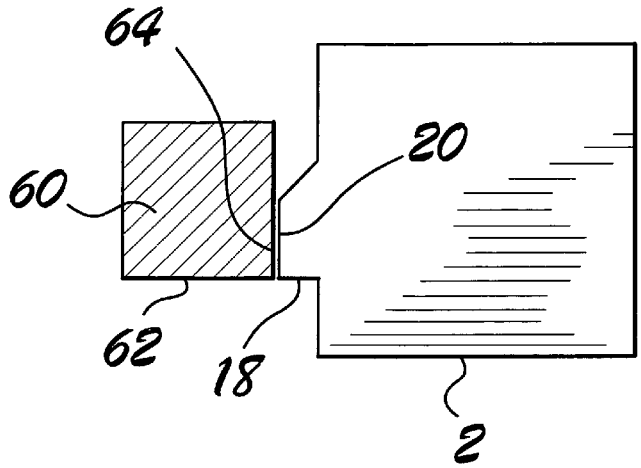
FIGS. 14-19 depict the instant method steps of installing furring strips and finishing sheets such as dry wall around the opening.

FIG. 14 is a top cross-sectional view of window frame 60 and an adjacent buck block 2 taken at section XIV-XIV of FIG. 10. As previously described, window frame 60 has been installed in opening 3. Window frame front 62 is substantially coplanar with buck strip face 18, and window frame outer side 64 is flat against buck strip side 20.

Figure 15:
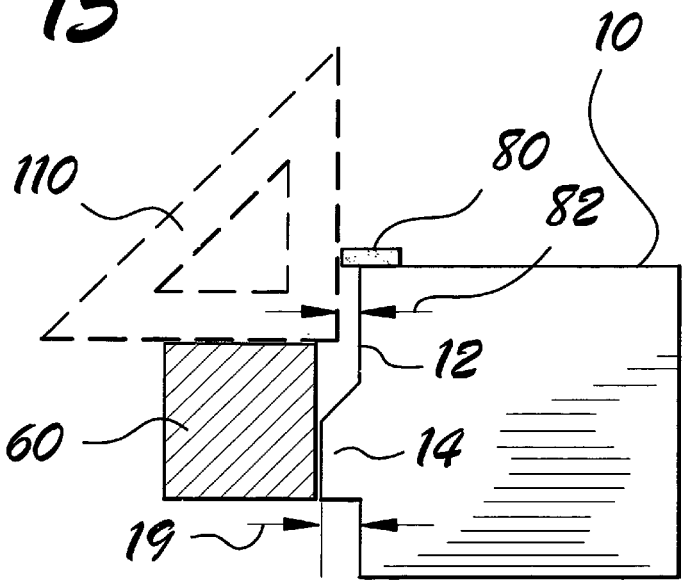
Figure 17:
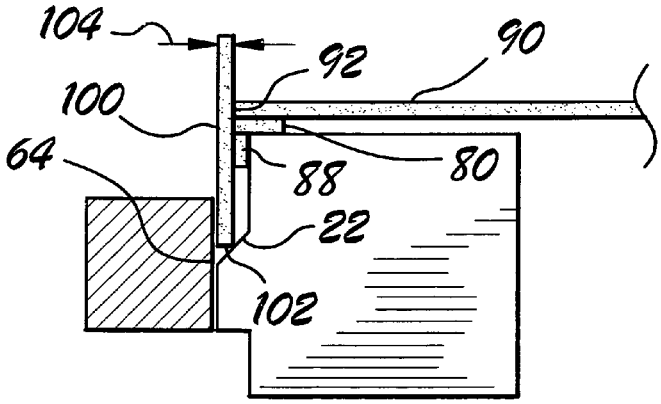

As depicted in FIG. 15, first furring strip 80 is installed vertically, flat against buck block rear 10, extending beyond the buck block side 12 containing block buck strip 14 by a first furring strip extension distance 82 equal to buck strip face width 19 minus second finishing sheet width 104 (see also FIG. 17). First furring strip 80 is attached to buck block rear 10 using conventional fasteners. Carpenter's square 110 may be used as an aid in this step.

Figure 16:
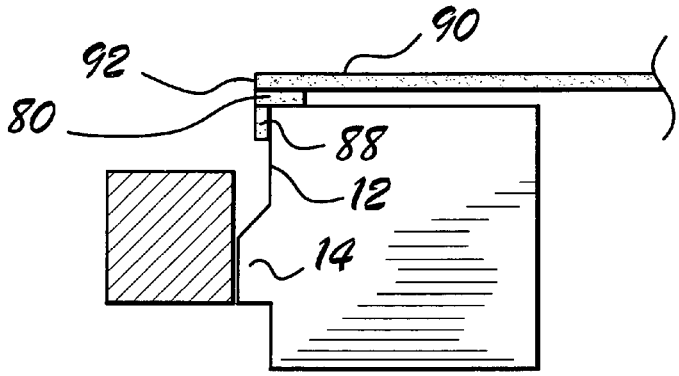

Next, as depicted in FIG. 16, first finishing sheet 90 is installed flat against first furring strip 80, with its first finishing sheet proximal edge 92 extending beyond buck block side 12 the same distance as furring strip 80. First finishing sheet 90 and second finishing sheet 100 may be drywall sheets, plywood, wood paneling, or any other appropriate material.

Optional second furring strip 88 may be installed flat against the buck block side 12 having block buck strip 14, butting up against first furring strip 80 as depicted in FIGS. 16 and 17, using conventional fasteners.

Next, as depicted in FIG. 17, second finishing sheet 100 is installed with one of its sides in contact with first furring strip 80 and first finishing sheet proximal edge 92, with its second finishing sheet proximal edge 102 wedged between window frame outer side 64 and buck strip ramp 22. Buck strip ramp angle 24 holds second finishing sheet proximal edge 102 securely against window frame outer edge 64, and conventional fasteners are used to attach second finishing sheet 100 to first finishing sheet 90, first furring strip 80, and/or optional second furring strip 88.

Figure 18:
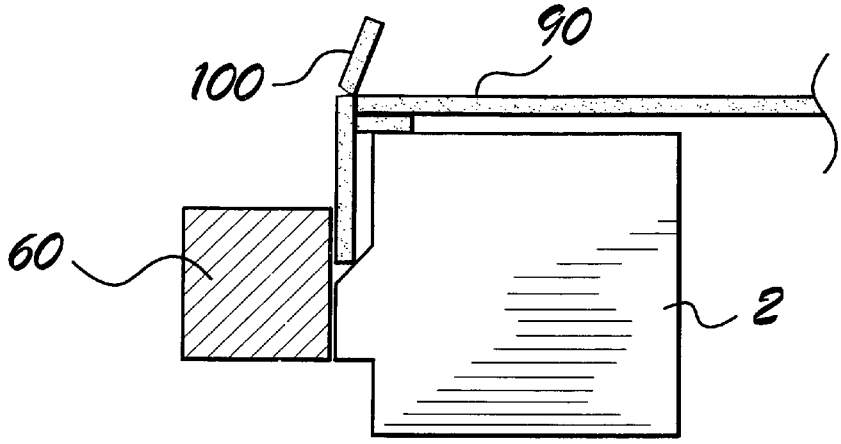
Figure 19:
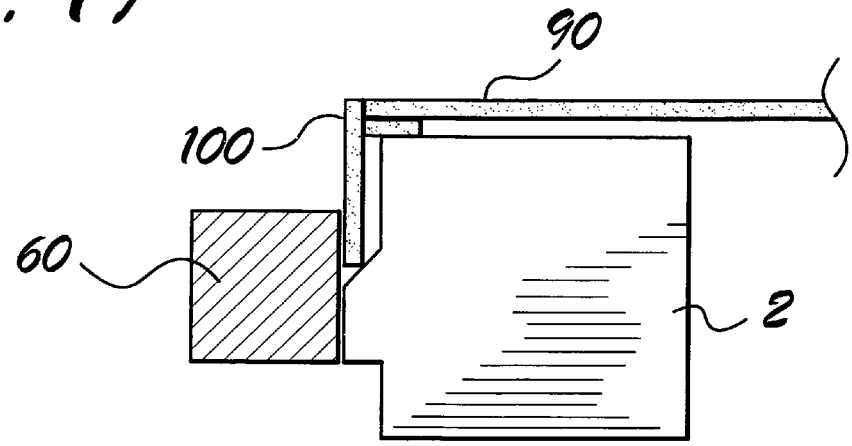

Last, as depicted in FIGS. 18 and 19, second finishing sheet 100 is trimmed flush with first finishing sheet 90. This may be accomplished by scoring and breaking second finishing sheet 100 in conventional fashion, by cutting off the excess width of second finishing sheet 100 with a saw or other appropriate tool, etc.

Thus, the instant disclosure teaches a method of framing using buck blocks, each buck block comprising a block buck strip attached to a buck block side, the method comprising the steps of:

A. Laying conventional blocks 1 until an opening bottom height is reached;
B. Laying a first buck block 2 at an edge of opening 3, its block bucking strip 14 facing opening 3;
C. Installing a sill 30 adjacent the buck block 2;
D. Laying a second buck block 2 adjacent the sill 30 opposite the first buck block 2, a block bucking strip 14 corresponding to the second buck block 2 facing opening 3;
E. Continuing to lay buck blocks 2 up opposing sides of opening 3, block buck strips 14 on the buck blocks 2 facing opening 3;

F. Laying buck lentil 40 across a top of opening 3 on an uppermost opposing pair of buck blocks 2, buck lentil 40 comprising a lentil buck strip 46, lentil buck strip 46 facing opening 3;

G. Installing frame 60 within opening 3;

H. Installing first furring strip 80 vertically flat against buck block rear 10, extending beyond the buck block side 12 containing block buck strip 14 by a first furring strip extension distance 82 equal to buck strip face width 19 minus second finishing sheet width 104;

I. Installing a first finishing sheet 90 flat against first furring strip 80, with its first finishing sheet proximal edge 92 extending beyond buck block side 12 the same distance as furring strip 8;

J. Installing second finishing sheet 100 with one of its sides in contact with first furring strip 80 and first finishing sheet proximal edge 92, with its second finishing sheet proximal edge 102 wedged between window frame outer side 64 and buck strip ramp 22, whereby buck strip ramp angle 24 holds second finishing sheet proximal edge 102 securely against window frame outer edge 64; and K. Trimming second finishing sheet 100 flush with first finishing sheet 90.

The method may comprise the further step of installing a second furring strip 88 flat against the buck block side 12 having block buck strip 14, butting up against first furring strip 80.

The method may comprise the further step of trimming second finishing sheet 100 flush with first finishing sheet 90 by scoring and breaking second finishing sheet 100.

The method may comprise the further step of making buck block strip cutouts 15 at the lower extremes of block buck strips 14 pertaining to a lowermost pair of opposing buck blocks 2, each buck block strip cutout 15 being sized to admit an extreme of sill 30.

The instant disclosure also teaches the alternative method of framing using buck blocks 2 comprising a block buck strip 14 attached to a buck block side 12, a buck lentil 40 comprising a lentil buck strip 46 along a buck lentil bottom 44, and installation of frame 60 after sill 30 is installed, the method comprising the steps of:

A. Laying conventional blocks 1 until an opening bottom height is reached;

B. Laying a first buck block 2 at an edge of opening 3, its block bucking strip 14 facing opening 3;

C. Installing sill 30 adjacent the buck block 2;

D. Installing frame 60 on sill 30;

E. Laying a second buck block 2 flush against frame 60 opposite the first buck block 2, its block bucking strip 14 facing opening 3;

F. Continuing to lay buck blocks 2 up opposing sides of frame 60, block buck strips 14 on the buck blocks 2 facing frame 60; and G. Laying buck lentil 40 across a top of opening 4 on an uppermost opposing pair of buck blocks 2, buck lentil 40 comprising a lentil buck strip 46, lentil buck strip 46 facing frame 60;

H. Installing a first furring strip 80 vertically flat against buck block rear 10, extending beyond the buck block side 12 containing block buck strip 14 by a first furring strip extension distance 82 equal to buck strip face width 19 minus second finishing sheet width 104;

I. Installing a first finishing sheet 90 flat against first furring strip 80, with its first finishing sheet proximal edge 92 extending beyond buck block side 12 the same distance as furring strip 8;

J. Installing second finishing sheet 100 with one of its sides in contact with first furring strip 80 and first finishing sheet proximal edge 92, with its second finishing sheet proximal edge 102 wedged between window frame outer side 64 and buck strip ramp 22, whereby buck strip ramp angle 24 holds second finishing sheet proximal edge 102 securely against window frame outer edge 64; and K. Trimming second finishing sheet 100 flush with first finishing sheet 90.

The alternative method may comprise the further step of installing a second furring strip 88 flat against the buck block side 12 having block buck strip 14, butting up against first furring strip 80.

The alternative method may comprise the further step of trimming second finishing sheet 100 flush with first finishing sheet 90 by scoring and breaking second finishing sheet 100.

The alternative method may comprise the further step of making buck block strip cutouts 15 at the lower extremes of block buck strips 14 pertaining to a lowermost pair of opposing buck blocks 2, each buck block strip cutout 15 being sized to admit an extreme of sill 30.

In the preferred embodiment, buck blocks 2, sill 30, buck lentil 40, and form 60 were fabricated of block material, concrete, brick, recycled material, synthetic, or other appropriate material. Buck blocks 2, buck lentil 40 and buck sill 30 were of monolithic, unitary, one-piece construction.

While a preferred embodiment of the invention has been illustrated herein, it is to be understood that changes and variations may be made by those skilled in the art without departing from the spirit of the appending claims.

DRAWING ITEM INDEX

1 conventional block
2 buck block
3 opening
4 buck block top
6 buck block bottom
8 buck block front
10 buck block rear
12 buck block side
14 block buck strip
15 block buck strip cutout
18 buck strip face
19 buck strip face width
20 buck strip side
22 buck strip ramp
24 buck strip ramp angle
30 sill
32 sill buck strip
40 buck lentil
42 buck lentil bottom
44 buck lentil side
46 lentil buck strip
48 lentil buck strip cutout
60 window frame
62 window frame front
64 window frame outer side
73 fastener
74 arrow
80 first furring strip
82 first furring strip extension distance
88 second furring strip
90 first finishing sheet
92 first finishing sheet proximal edge
100 second finishing sheet
102 second finishing sheet proximal edge

104 second finishing sheet width
110 carpenter's square

I claim:

1. An apparatus for framing an opening in a structure comprising a buck block, said buck block comprising a buck block top, buck block bottom, buck block front, buck block rear, and buck block sides, and a block buck strip disposed on one of said buck block sides, said block buck strip configured to abut framing in the opening and extending from said buck block bottom to said buck block top, said block buck strip comprising a buck strip ramp disposed at a buck strip ramp angle relative to said buck block side, said buck strip ramp angle being 34 degrees+15 degrees, wherein said buck block being integrally formed with said block buck strip.

2. The apparatus for framing of claim 1 further comprising a buck lentil, said buck lentil comprising a lentil buck strip on a buck lentil bottom.

3. The apparatus for framing of claim 2 wherein a cross-sectional shape of said lentil buck strip is substantially the same as a cross-sectional shape of said block buck strip.

4. The apparatus for framing of claim 1 wherein said block buck strip comprises a buck strip face perpendicular to said buck block side and is disposed at an edge of said block buck strip nearest said buck block front, the buck strip ramp disposed at an edge of said block buck strip nearest said buck block rear, and a buck strip side substantially parallel to said buck block side disposed between said buck strip face and said buck strip ramp.

5. A method of framing using buck blocks comprising the steps of:

A. providing a plurality of buck blocks, each comprising a buck block top, buck block bottom, buck block front, buck block rear, and buck block sides, and a block buck strip disposed on one of said buck block sides, said block buck strip extending from said buck block bottom to said buck block top and comprising a buck strip face perpendicular to said buck block side and disposed at an edge of said block buck strip nearest said buck block front, a buck strip ramp disposed at a buck strip ramp angle to said buck block side and disposed at an edge of said block buck strip nearest said buck block rear, and a buck strip side substantially parallel to said buck block side disposed between said buck strip face and said buck strip ramp;

B. laying conventional blocks until an opening bottom height is reached;

C. laying a first buck block of the plurality of buck blocks at an edge of an opening, said block buck strip facing said opening;

D. installing a sill adjacent said first buck block;

E. laying a second buck block of the plurality of buck blocks adjacent said sill opposite said first buck block, said block buck strip corresponding to the second buck block facing said opening; and F. continuing to lay the plurality of buck blocks up opposing sides of said opening, each of the block buck strips on the plurality of buck blocks facing said opening, whereby a continuous buck strip is created from said block buck strips on each side of said opening.

6. A method of framing using buck blocks comprising the steps of:

A. providing a plurality of buck blocks, each comprising a buck block top, buck block bottom, buck block front, buck block rear, and buck block sides, and a block buck strip disposed on one said buck block side, said block buck strip extending from said buck block bottom to said buck block top and comprising a buck strip face perpendicular to said buck block side and disposed at an edge of said block buck strip nearest said buck block front, a buck strip ramp disposed at a buck strip ramp angle to said buck block side and disposed at an edge of said block buck strip nearest said buck block rear, and a buck strip side substantially parallel to said buck block side disposed between said buck strip face and said buck strip ramp;

B. laying conventional blocks until an opening bottom height is reached;

C. laying a first buck block of the plurality of buck blocks at an edge of an opening, said block buck strip facing said opening;

D. installing a sill adjacent said first buck block;

E. laying a second buck block of the plurality of buck blocks adjacent said sill opposite said first buck block, said block buck strip corresponding to the second buck block facing said opening;

F. continuing to lay the plurality of buck blocks up opposing sides of said opening, each of the block buck strips on the plurality of buck blocks facing said opening;

G. providing a frame having a frame outer side, a first furring strip, a first finishing sheet having a first finishing sheet proximal edge, and a second finishing sheet having a second finishing sheet proximal edge;

H. installing said frame within said opening;

I. installing the first furring strip vertically flat against one of said buck block rears of the plurality of buck blocks, extending beyond the buck block side containing said block buck strip by a first furring strip extension distance equal to a buck strip face width minus a second finishing sheet width;

J. installing said first finishing sheet flat against said first furring strip, with the first finishing sheet proximal edge extending beyond said buck block side a distance equal to said first furring strip extension distance;

K. installing said second finishing sheet with a side in contact with said first furring strip and said first finishing sheet proximal edge, with said second finishing sheet proximal edge wedged between said frame outer side and said buck strip ramp, whereby said buck strip ramp angle holds said second finishing sheet proximal edge securely against said frame outer edge; and L. trimming said second finishing sheet flush with said first finishing sheet.

7. The method of framing using buck blocks of claim 6 comprising the further step of installing a second furring strip flat against the buck block side having said block buck strip, butting up against said first furring strip.

8. The method of framing using buck blocks of claim 6 comprising the further step of trimming said second finishing sheet flush with said first finishing sheet by scoring and breaking said second finishing sheet.

9. The method of framing using buck blocks of claim 6 comprising the further step of making buck block strip cutouts at lower extremes of said block buck strips pertaining to a lowermost pair of opposing buck blocks of the plurality of bucks blocks, each said buck block strip cutout being sized to admit an extreme end of said sill.

10. The method of framing using buck blocks of claim 6 comprising the further step of providing said buck strip ramp angle equal to 34 degrees±15 degrees.

11. A method of framing using buck blocks comprising the steps of:

A. providing a frame having a frame outer edge and a plurality of buck blocks, each of said plurality of buck blocks comprising a buck block top, buck block bottom, buck block front, buck block rear, and buck block sides, and a block buck strip disposed on one of said buck block sides, said block buck strip extending from said buck block bottom to said buck block top and comprising a buck strip face perpendicular to said buck block side and disposed at an edge of said block buck strip nearest said buck block front, a buck strip ramp disposed at a buck strip ramp angle to said buck block side and disposed at an edge of said block buck strip nearest said buck block rear, and a buck strip side substantially parallel to said buck block side disposed between said buck strip face and said buck strip ramp;

B. laying conventional blocks until an opening bottom height is reached;

C. laying a first buck block of the plurality of buck blocks at an edge of an opening, said corresponding block buck strip facing the opening;

D. installing a sill adjacent said first buck block;

E. installing said frame on the sill;

F. laying a second buck block of the plurality of buck blocks flush against the frame opposite the first buck block, said corresponding block buck strip facing the opening; and G. continuing to lay said plurality of buck blocks up opposing sides of the frame, each of the block buck strips on the plurality of buck blocks facing and butting against said frame, whereby a continuous buck strip is created from said block buck strips on each side of said opening.

12. A method of framing using buck blocks comprising the steps of:

A. providing a frame having a frame outer edge and a plurality of buck blocks, each of said plurality of buck blocks comprising a buck block top, buck block bottom, buck block front, buck block rear, and buck block sides, and a block buck strip disposed on one said buck block side, said block buck strip extending from said buck block bottom to said buck block top and comprising a buck strip face perpendicular to said buck block side and disposed at an edge of said block buck strip nearest said buck block front, a buck strip ramp disposed at a buck strip ramp angle to said buck block side and disposed at an edge of said block buck strip nearest said buck block rear, and a buck strip side substantially parallel to said buck block side disposed between said buck strip face and said buck strip ramp;

B. laying conventional blocks until an opening bottom height is reached;

C. laying a first buck block of the plurality of buck blocks at an edge of an opening, said corresponding block buck strip facing the opening;

D. installing a sill adjacent said first buck block;

E. installing said frame on the sill;

F. laying a second buck block of the plurality of buck blocks flush against the frame opposite the first buck block, said corresponding block buck strip facing the opening;

G. continuing to lay said plurality of buck blocks up opposing sides of the frame, each of the block buck strips on the plurality of buck blocks facing and butting against said frame;

H. providing a first furring strip, a first finishing sheet having a first finishing sheet proximal edge, and a second finishing sheet having a second finishing sheet proximal edge;

I. installing said first furring strip vertically flat against one of said buck block rears of the plurality of buck blocks, extending beyond the buck block side containing said block buck strip by a first furring strip extension distance equal to a buck strip face width minus a second finishing sheet width;

J. installing said first finishing sheet flat against said first furring strip, with the first finishing sheet proximal edge extending beyond said buck block side a distance equal to said first furring strip extension distance;

K. installing said second finishing sheet with a side in contact with said first furring strip and said first finishing sheet proximal edge, with said second finishing sheet proximal edge wedged between said frame outer side and said buck strip ramp, whereby said buck strip ramp angle holds said second finishing sheet proximal edge securely against said frame outer edge; and L. trimming said second finishing sheet flush with said first finishing sheet.

13. The method of framing using buck blocks of claim 12 comprising the further step of installing a second furring strip flat against the buck block side having said block buck strip, butting up against said first furring strip.

14. The method of framing using buck blocks of claim 12 comprising the further step of trimming said second finishing sheet flush with said first finishing sheet by scoring and breaking said second finishing sheet.

15. The method of framing using buck blocks of claim 12 comprising the further step of making buck block strip cutouts at lower extremes of said block buck strips pertaining to a lowermost pair of opposing buck blocks of the plurality of bucks blocks, each said buck block strip cutout being sized to admit an extreme end of said sill.

16. The method of framing using buck blocks of claim 12 comprising the further step of providing said buck strip ramp angle equal to 34 degrees±15 degrees.

17. A method of framing using buck blocks comprising the steps of:

A. providing a plurality of one-piece buck blocks, each comprising a buck block top, buck block bottom, buck block front, buck block rear, and buck block sides, and a block buck strip disposed on one of said buck block sides, said block buck strip extending from said buck block bottom to said buck block top and comprising a buck strip face perpendicular to said buck block side and disposed at an edge of said block buck strip nearest said buck block front, a buck strip ramp disposed at a buck strip ramp angle of 34 degrees±15 degrees to said buck block side and disposed at an edge of said block buck strip nearest said buck block rear, and a buck strip side substantially parallel to said buck block side disposed between said buck strip face and said buck strip ramp;

B. laying conventional blocks until an opening bottom height is reached;

C. laying a first buck block of the plurality of buck blocks at an edge of an opening, said block buck strip facing said opening;

D. installing a sill adjacent said first buck block;

E. laying a second buck block of the plurality of buck blocks adjacent said sill opposite said first buck block, said block buck strip corresponding to the second buck block facing said opening;

F. continuing to lay the plurality of buck blocks up opposing sides of said opening, each of the block buck strips on the plurality of buck blocks facing said opening;

G. providing a frame having a frame front and a frame outer side, a first furring strip, a first finishing sheet having a first finishing sheet proximal edge, and a second finishing sheet having a second finishing sheet proximal edge;

H. installing said frame within said opening so that said frame front is substantially co-planar with one of said buck strip faces of said plurality of buck blocks, and said frame outer side is flat against one of said buck strip sides of said plurality of bucks blocks;

I. installing a first furring strip vertically flat against one of said buck block rears of the plurality of buck blocks, extending beyond the buck block side containing said block buck strip by a first furring strip extension distance equal to a buck strip face width minus a second finishing sheet width;

J. installing said first finishing sheet flat against said first furring strip, with the first finishing sheet proximal edge extending beyond said buck block side a distance equal to said first furring strip extension distance;

K. installing said second finishing sheet with a side in contact with said first furring strip and said first finishing sheet proximal edge, with said second finishing sheet proximal edge wedged between said frame outer side and said buck strip ramp, whereby said buck strip ramp angle holds said second finishing sheet proximal edge securely against said frame outer edge; and L. trimming said second finishing sheet flush with said first finishing sheet.

18. The method of framing using buck blocks of claim 17 comprising the further steps of laying a buck lentil across a top of said opening on an uppermost opposing pair of buck blocks of the plurality of bucks blocks, said buck lentil comprising a lentil buck strip of substantially the same cross-sectional shape as said block buck strip, said lentil buck strip facing the frame.

19. The method of framing using buck blocks of claim 17 comprising the further step of installing a second furring strip flat against the buck block side having said block buck strip, butting up against said first furring strip.

20. The method of framing using buck blocks of claim 17 comprising the further step of providing a frame which is a window frame.

21. The method of framing using buck blocks of claim 17 comprising the further step of providing a frame which is a door frame.

* * * * *